US005382739A

United States Patent [19]

Atkins et al.

[11] Patent Number: 5,382,739

[45] Date of Patent: Jan. 17, 1995

[54] LUBRICATING OILS

[75] Inventors: Martin P. Atkins, Ashford; Mark R. Smith, Sunbury-on-Thames, both of England

[73] Assignee: BP Chemicals Limited, London, England

[21] Appl. No.: 90,287

[22] Filed: Jul. 12, 1993

[30] Foreign Application Priority Data

Jul. 28, 1992 [GB] United Kingdom ..... 9216014

[51] Int. Cl.[6] ..... C07C 2/26

[52] U.S. Cl. ..... 585/530; 585/12; 585/255; 585/329; 585/520; 585/531

[58] Field of Search ..... 585/255, 329, 502, 520, 585/530, 531, 12

[56] References Cited

U.S. PATENT DOCUMENTS

| | | | |
|---|---|---|---|
| 4,041,098 | 8/1977 | Loveless | 585/521 |
| 4,376,222 | 3/1983 | Shubkin | 585/255 |
| 4,434,309 | 2/1984 | Larkin . | |
| 4,613,712 | 9/1986 | Bridger | 585/10 |
| 4,626,415 | 12/1986 | Tabak | 422/190 |
| 5,157,177 | 10/1992 | Perline et al. | 585/10 |
| 5,513,156 | 4/1985 | Tabak . | |

FOREIGN PATENT DOCUMENTS

| | | |
|---|---|---|
| 139343 | 5/1985 | European Pat. Off. . |
| 0220775 | 5/1987 | European Pat. Off. . |
| 270001 | 6/1988 | European Pat. Off. . |
| 0318086 | 5/1989 | European Pat. Off. . |
| 377306 | 7/1990 | European Pat. Off. . |
| 0468109 | 1/1992 | European Pat. Off. . |
| 963970 | 7/1964 | United Kingdom . |
| 9013620 | 11/1990 | WIPO . |

*Primary Examiner*—Asok Pal

*Attorney, Agent, or Firm*—Brooks Haidt Haffner & Delahunty

[57] ABSTRACT

This invention relates to a process for the production of lubricating oils having a viscosity index of at least 120 and a pour point of at least −45° C. by (a) oligomerizing a mixture of C5-C20 1-olefins comprising at least 2.6% w/w of 1-decene and at least 6% w/w of 1-hexene in the presence of a catalyst. The lubricating oil so formed may be hydrogenated in the presence of hydrogen to improve the oxidation stability thereof. The process is particularly suited to olefins feeds produced during a Fischer-Tropsch synthesis in which carbon monoxide and hydrogen are passed over a heated catalyst.

7 Claims, No Drawings

LUBRICATING OILS

This invention relates to a process for the production of lubricating oils from a mixed feedstock comprising 1-olefins having 5 to 20 carbon atoms.

BACKGROUND TO INVENTION

It is well known to oligomerize 1-olefins to hydrocarbons of higher molecular weight and then to hydrogenate or isomerise the oligomer so formed to produce lubricating oils (See e.g.) U.S. Pat. No. 3,763,244. In most of these cases, the 1-olefins are derived initially from ethylene (by the so called "ethylene chain growth and displacement" method) which is a relatively expensive source for such 1-olefins. Moreover, lubricating oils have been produced by oligomerization of relatively pure 1-olefins (see U.S. Pat. No. 3,780,128 and EP-A-0 468 109). This last document also discloses that once the oligomers have been produced, the oligomers of various 1-olefins can be blended either before or after the hydrogenation or isomerization steps in order to produce the lubricating oils of the desired properties such as viscosity index and pour point. One of the problems with this technique of blending is that the final oligomer has a mixture/blend of discrete molecules e.g. a mixture of C20, C30 and C40 hydrocarbons and hence the blend lacks consistency of properties due the absence of a continuity and gradual blending of closely related/matched oligomers. It is also known to oligomerize the olefinic products from a Fischer Tropsch synthesis followed by hydrogenation or isomerization of the oligomer to form lubricating oils (see e.g. Monoolefins, Chemistry & Technology, by F. Asinger, pp 900 and 1089 (1968) and published by Pergamon Press). However, the publications relating to use of the Fischer Tropsch products as the source material for the oligomerization step do not indicate the product mix required to achieve the desired oligomer or the catalyst suitable for the oligomerization step.

SUMMARY OF INVENTION

It has now been found, for instance, that a specific mixture of 1-olefins which is commercially available from conventional Fischer Tropsch processes is a very desirable feed for the oligomerization step and the oligomers thus formed can be optionally hydrogenated to form lubricating oils.

Accordingly, the present invention is a process for the production of lubricating oils having a viscosity index of at least 120 and a pour point of at least −45° C., said process comprising a) oligomerizing a mixture of C5–C20 1-olefins comprising at least 2.6% w/w of 1-decene and at least 6% w/w of 1-hexene in the presence of an oligomerization catalyst to form a lubricating oil, b) separating the lubricating oil from the oligomerization catalyst, c) optionally catalytically hydrogenating the lubricating oil in the presence of hydrogen to improve the oxidation stability thereof and d) recovering the lubricating oil formed in (b) or (c) above.

The mixed 1-olefin feedstock suitably comprises olefins having 4–18 carbon atoms, preferably 5–12 carbon atoms. A particularly preferred example of such a feedstock is the olefin stream formed by the Fischer Tropsch synthesis.

DETAILED DESCRIPTION OF THE INVENTION

Normally in a Fischer Tropsch synthesis (hereafter "FTS"), a mixture of carbon monoxide and hydrogen is passed over or through a heated catalyst bed to form a wide variety of hydrocarbons. When the hydrogen content of the reactant mixture is high, the reaction products predominantly contain paraffinic hydrocarbons. However, if the proportion of hydrogen in the reaction mixture is low, the reaction products predominantly contain olefinic hydrocarbons.

It is, however, important that even in the case where the reaction products of the FTS are predominantly olefins, the reaction conditions of the FTS have to be controlled to obtain the desired mixture of 1-olefins. For instance, Gasol derived by FTS and described in "Mono-olefins Chemistry & Technology", by F. Asinger, page 1089 (1968), published by Pergamon Press, contains about 50% but-2-ene and is said to give poor lubricating materials on polymerization with aluminium chloride. Thus, any unspecified product mix of an unspecified FTS is unlikely to be suitable as feedstock for the process of the present invention. In fact, it is essential that if the products of an FTS are used as feedstock, the FTS is operated in such a manner that the olefin products of the synthesis contain at least 2.6% w/w of 1-decene, preferably at least 7% w/w, and at least 6% w/w of 1-hexene, preferably at least 13% w/w. Such a product mix can be obtained by the conventional FTS processes in which the conditions of operation should be so controlled that the product has a Schulz-Flory alpha value from 0.6–0.9, preferably from 0.7–0.8. The Schulz-Flory alpha value is a well recognised concept and is defined e.g. by P. J. Flory in "J Am Chem Soc", 58, 1877 (1950); and by G. V. Schulz in "Z Phys Chem ", B43, 25 (1935). This value can be defined by the following equation:

$$\log[Wn/n]=n\log\alpha+[(1-\alpha)^2/\alpha]$$

where Wn is the weight fraction, n is the carbon number and $\alpha$ the probability of chain growth.

In this context the choice of the oligomerization catalyst used is also important. Whilst any of the conventional cationic polymerization catalysts can be used, it is preferable that the catalyst used in a combination of an organo aluminum compound and an alkyl halide. Thus, the organo aluminum compound is suitably represented by the generic formula $R_nAlX_{3-n}$, wherein R is a C1–C4 primary, secondary or tertiary alkyl group, preferably a primary or secondary alkyl group, more preferably an alkylaluminium halide (hereafter "AAH"); X is a halogen atom which may be chlorine, bromine or iodine, preferably chlorine; and n is an integer from 1 to 3, preferably 1 to 2. The alkyl halide component of the catalyst suitably has the formula $R_3X$ wherein R and X have the same significance as above and is preferably a tertiary alkyl group e.g. tert-butyl chloride (hereafter "TBC"). The AAH is preferably ethyl aluminium dichloride (hereafter "EADC"). The relative mole ratios of TBC to AAH in the oligomerization catalyst is suitably in the range from 2.0:1 to 20:1, preferably from 2.5:1 to 15:1.

It is also important to control the ratio of the catalytic components to the 1-olefin in the feed. For instance, if the 1-olefin feed in the mixture comprises a blend of C6–C10 1-olefins, the mole ratios of olefin to TBC may suitably vary in the range from 15:1 to 80:1, preferably from 18:1 to 75:1; and the mole ratio of 1-olefin to AAH, may suitably vary in the range from 75:1 to 500:1, preferably from 85:1 to 470:1.

The precise concentration of the two catalytic components chosen would depend upon the specific property desired in the final lubricating oil such as e.g. the viscosity.

The oligomerization is suitably carried out at ambient temperature, e.g. temperatures from −30° C. to 150° C., more preferably around 0°–20° C. The reaction pressures can be ambient or elevated.

The oligomerization is suitably carried out in the presence of a solvent inert under the reaction conditions, preferably a paraffinic hydrocarbon e.g. n-hexane.

It is preferable to add initially to a solution of the 1-olefins feedstock in an inert solvent the required amount of TBC and to bring the temperature of this solution to the reaction temperature. Thereafter a solution of AAH, preferably in the same inert solvent, is added dropwise with continuous stirring to that of the 1-olefins and TBC over a period of time. After the addition of the EADC solution is completed and a further duration allowed to elapse, the reaction mixture can be neutralised e.g. by the addition of ammonia, then washed and filtered. The organic products can then be rendered free of the inert solvent by e.g. evaporation. The above steps can be, if desired, carried out in continuous operation.

The resultant residue is an oligomer. This oligomer is a lubricating oil with important and desirable properties but may contain a small proportion of olefinic groups.

An important aspect of this invention is that by choosing the appropriate feeds, oligomerization catalyst and oligomerization conditions, it is possible to ensure that the oligomer is very low in olefinic groups thereby substantially obviating the need for the subsequent optional hydrogenation step.

The hydrogenation step, when used, is suitably carried out to ensure that any olefinic groups in the oligomer are saturated. The effect of this is to improve the oxidation stability of the lubricating oil formed in step (b). The hydrogenation step in the present case can be carried out using any of the conventional hydrogenation catalysts such as e.g. Raney nickel or other Group VII or Group VIII metal according to the Periodic Table due to Mendeleef. This step is carried out in the presence of hydrogen. The reaction pressure for this step (including the hydrogen partial pressures) is suitably in the range from 20 to 1000 KPa, preferably from 350 to 750 KPa. The hydrogenation is suitably carried out at a temperature in the range from 0° to 350° C.

The hydrogenated product is separated from the catalyst and any by-products by well known techniques e.g. by distillation.

The hydrogenated products of the present invention are excellent lubricants and can be used as such or for blending with other additives in a lubricating oil. The products of the present process can have pour points of up to −65° C. and viscosity index values above 155, e.g. 160.

In view of the synthetic source of these oils they are biodegradable and hence are environmentally more friendly.

The present invention is further illustrated with reference to the following Examples:

EXAMPLES

A mixture of 1-hexene (31 g), 1-heptene (27 g), 1-octene (24 g), 1-nonene (20 g) and 1-decene (17 g) was blended with n-hexane (217 g) in a reservoir (total mass of 1-olefins 119 g). Tertiary-butyl chloride (TBC, 6 g) was added to this blend and the applied temperature set at 20° C.

Ethyl aluminium dichloride (EADC, 13 ml of a 1.0 molar solution) in "hexane" (ex Aldrich Chemicals) was then added to the 1-olefin/TBC blend dropwise with stirring over a period of 2 hours. 4 hours after the addition of EADC was commenced, the reaction was stopped by adding sufficient anhydrous ammonia gas to deactivate the catalyst. After ammonia addition, the reaction mixture was washed and filtered to separate a white solid precipitate predominantly comprising sluminium hydroxide. The resultant filtrate containing the organic product was placed in an evaporating tray and the hexane solvent was allowed to evaporate overnight.

The material that remained upon evaporation of hexane from the organic product (filtrate) was a lubricating oil (110 g) representing a yield of 92% w/w from the 1-olefins. This oil had a viscosity of 93.4 cSt at 40° C, a viscosity of 12.33 cSt at 100° C., a viscosity index of 124 and a pour point of −54° C.

The following Table summarises the results of further experiments carried out according to the process described below using varying process conditions (as shown) in order to study the effect of such variations on the product:

Hexene-1 (205 g), octene-1 (158 g), decene-1 (116 g) and n-hexane (215 g) were mixed with tertiary butyl chloride (TBC) in amounts indicated and at the temperatures shown in the Table. A volume (as shown in the Table) of 1 molar ethylaluminium dichloride in hexanes (ex Aldrich) was added slowly to the above mixture with constant stirring. After the desired reaction time had elapsed, the reaction was terminated by the addition of anhydrous ammonia and the reaction mixture was then washed with water. A white solid product formed (which was probably aluminium hydroxide) was separated from the reaction mixture by filtration. The aqueous and hydrocarbon phases in the filtrate were separated and the hexane in the hydrocarbon phase allowed to evaporate overnight. The residue remaining after removal of hexane was a lubricating oil having the properties shown in Table 1 below

EFFECT OF PROCESS CONDITIONS ON LUBRICANTS FORMED

| Run Conditions | | | | Viscosity (cSt) at | | | Pour Point | Yield |
|---|---|---|---|---|---|---|---|---|
| AAH, | TBC, | Temp, | Hr | 40° C. | 100° C. | VI | (°C.) | (%) |
| 25 ml, | 13 g, | 20° C., | 4 h | 78.1 | 10.77 | 125 | −45 | 97 |
| 25 ml, | 13 g, | 0° C., | 2 h | 84.25 | 12.15 | 139 | −57 | 98 |
| 25 ml, | 6 g, | 0° C., | 4 h | 60.59 | 10.32 | 160 | −45 | 98 |
| 10 ml, | 13 g, | 20° C., | 2 h | 30.38 | 5.82 | 138 | <−63 | 52 |

-continued

EFFECT OF PROCESS CONDITIONS ON LUBRICANTS FORMED

| Run Conditions | | | | Viscosity (cSt) at | | | Pour Point | Yield |
|---|---|---|---|---|---|---|---|---|
| AAH, | TBC, | Temp, | Hr | 40° C. | 100° C. | VI | (°C.) | (%) |
| 10 ml, | 6 g, | 20° C., | 4 h | 6.07 | 2.08 | 160 | <−66 | 45 |

A further set of experiments were performed in which the reaction mixture had a constant composition. Hexene-1 (240 g), Octene-1 (158 g), Decene-1 (113 g) and Heptane (213 g) were mixed in a reservoir.

The required amount of tertiary butyl chloride was added to the reservoir and temperature was set to the desired reaction temperature. The mixture was stirred vigorously. Ethyl aluminium dichloride (1.0 molar solution in hexanes) was added dropwise until a specific volume was added. During this addition an exotherm was observed. The rate of addition was controlled manually such that the exotherm was usually not allowed to exceed 10° C. and never allowed to exceed 20° C.

After the necessary reaction time the reaction was terminated by bubbling ammonia into the reaction mixture. Approximately 300 ml of distilled water was then added, the contents of the reservoir continued to be stirred vigorously. Reaction time is defined as the total time from when addition of ethyl aluminium dichloride commenced, to termination of the reaction by aqueous work-up.

During aqueous work-up, the reaction mixture separated into aqueous and organic phases. The organic phase was recovered and filtered through anhydrous magnesium sulphate. Subsequently the filtered organic phase was placed in an evaporating dish and the heptane was allowed to evaporate overnight. The resulting lubricant was analysed for viscosity at 40° C. and 100° C., viscosity index and pour point. No distillation was performed at this stage. The data obtained is recorded in Table 2 below.

Sample Conditions referred to in Table 2 are listed in the order: Volume of 1.0 molar ethyl aluminium dichloride, mass of tertiary butyl chloride, temperature (°C.) and time (hours). Viscosities are quoted in centistokes. The pour point in each case was <−53° C.

TABLE 2

| Sample Conditions | | | | Viscosity cSt | | VI | Yield |
|---|---|---|---|---|---|---|---|
| | | | | 40° C. | 100° C. | | (%) |
| 5 ml, | 26 g, | 0° C., | 3 h | 3.3 | 1.29 | — | 19 |
| 50 ml, | 26 g, | 30° C., | 3 h | 44.35 | 7.07 | 119 | 97 |
| 5 ml, | 3 g, | 30° C., | 3 h | 2.54 | 1.06 | * | 17 |
| 50 ml, | 3 g, | 30° C., | 6 h | 55.6 | 8.49 | 127 | 80 |
| 50 ml, | 3 g, | 0° C., | 6 h | 71.3 | 11.53 | 156 | 89 |
| 5 ml, | 26 g, | 0° C., | 3 h | 1.68 | 0.85 | * | 27 |
| 50 ml, | 26 g, | 0° C., | 6 h | 28.0 | 5.95 | 165 | 100 |
| 5 ml, | 3 g, | 0° C., | 6 h | 12.45 | 3.4 | 158 | 39 |
| 15 ml, | 10 g, | 10° C., | 3.5 h | 56.6 | 9.66 | 156 | 93 |
| 5 ml, | 10 g, | 10° C., | 3.5 h | 3.54 | 1.42 | * | 33 |
| 15 ml, | 10 g, | 10° C., | 2 h | 56.8 | 9.74 | 157 | 92 |
| 15 ml, | 26 g, | 10° C., | 3.5 h | 50.6 | 8.48 | 144 | 92 |
| 15 ml, | 10 g, | 30° C., | 3.5 h | 36.45 | 6.61 | 138 | 93 |
| 15 ml, | 10 g, | 0° C., | 3.5 h | 45.55 | 8.1 | 152** | 98 |
| 15 ml, | 10 g, | 10° C., | 6 h | 83.1 | 11.34 | 126# | 84 |

* - Not measured, value off-scale.
** - Pour point was <−63° C.
- Pour point was −54° C.

We claim:

1. A process for the production of lubricating oils having a viscosity index of at least 120 and a pour point of at least −45° C., said process comprising:

a. oligomerizing a mixture of C5–C20 1-olefins comprising at least 2.6% w/w of 1-decene and at least 6% w/w of 1-hexene in the presence of an oligomerization catalyst which comprises an alkylaluminum halide and tert-butyl chloride in which the relative mole ratio of tert-butyl chloride to alkylaluminium halide is in the range from 2.0:1 to 20:1 to form a lubricating oil.

b. separating the lubricating oil from the oligomerization catalyst;

c. optionally catalytically hydrogenating the lubricating oil in the presence of hydrogen to improve the oxidation stability thereof, and d. recovering the lubricating oil formed in (b) or (c) above.

2. A process according to claim 1 wherein the mixed 1-olefin feedstock comprises olefins having 4–18 carbon atoms.

3. A process according to claim 1 wherein the oligomerization is carried out at a temperature below 30° C.

4. A process according to claim 1 wherein the oligomerization is carried out in the presence of a solvent inert under the reaction conditions.

5. A process according to claim 1 wherein the hydrogenation is carried out to ensure that any olefinic groups in the lubricating oil are saturated.

6. A process according to claim 1 wherein the hydrogenation step is carried out using as catalyst Raney nickel or other Group VII or Group VIII metal according to the Periodic Table due to Mendeleef.

7. A process according to claim 1 wherein the hydrogenation is carried out at a reaction pressure of 20–1000 KPa inclusive of the hydrogen partial pressures and a temperature of 0°–350° C.

* * * * *

UNITED STATES PATENT AND TRADEMARK OFFICE

CERTIFICATE OF CORRECTION

PATENT NO. : 5,382,739

DATED : January 17, 1995

INVENTOR(S) : MARTIN P. ATKINS and MARK R. SMITH

It is certified that error appears in the above-indentified patent and that said Letters Patent is hereby corrected as shown below:

Col. 2, l. 47, change "in" to --is--

Col. 4, l. 26, correct the spelling of the word "aluminium"

Col. 4, l. 57, place a period (.) after the word "below."

Signed and Sealed this

Eighteenth Day of April, 1995

Bruce Lehman

*Attest:*

BRUCE LEHMAN

*Commissioner of Patents and Trademarks*

*Attesting Officer*